US006629507B2

(12) United States Patent
Biddison

(10) Patent No.: US 6,629,507 B2
(45) Date of Patent: Oct. 7, 2003

(54) CHINE SYSTEM FOR A BOAT HULL

(76) Inventor: Mark Biddison, 2715 SE. 24th Pl., Cape Coral, FL (US) 33904

( * ) Notice: Subject to any disclaimer, the term of this patent is extended or adjusted under 35 U.S.C. 154(b) by 0 days.

(21) Appl. No.: 09/773,077

(22) Filed: Jan. 31, 2001

(65) Prior Publication Data

US 2002/0100407 A1 Aug. 1, 2002

(51) Int. Cl.[7] ..... B63B 1/00
(52) U.S. Cl. ..... 114/271
(58) Field of Search ..... D12/300, 310, D12/312; 114/271, 61.27, 61.3, 61.32, 61.33, 62

(56) References Cited

U.S. PATENT DOCUMENTS 2,251,621 A * 8/1941 Van Hoorn ..... 114/271
4,004,542 A * 1/1977 Holmes ..... 114/271
4,192,248 A * 3/1980 Moyer ..... 114/56
4,708,085 A * 11/1987 Blee ..... 114/290
4,790,783 A * 12/1988 Karls ..... 440/66

* cited by examiner

*Primary Examiner*—Ed Swinehart
(74) *Attorney, Agent, or Firm*—Shook, Hardy & Bacon, L.L.P.

(57) ABSTRACT

A boat hull comprising a bottom panel that makes up the bottom of the boat hull. A first chine member has a base edge and an extended edge. The first chine member is coupled to the bottom panel at the base edge and protrudes generally in a vertical direction away from the boat hull. A curved member couples the extended edge of the first set of chines to a set of side panels. The set of side panels extend from the curved member to the gunwale making up the sides of the boat hull. A second set of chines are located on the set of side panels of the boat hull and extend in a horizontal direction away from the boat hull.

18 Claims, 4 Drawing Sheets

FIG. 8.
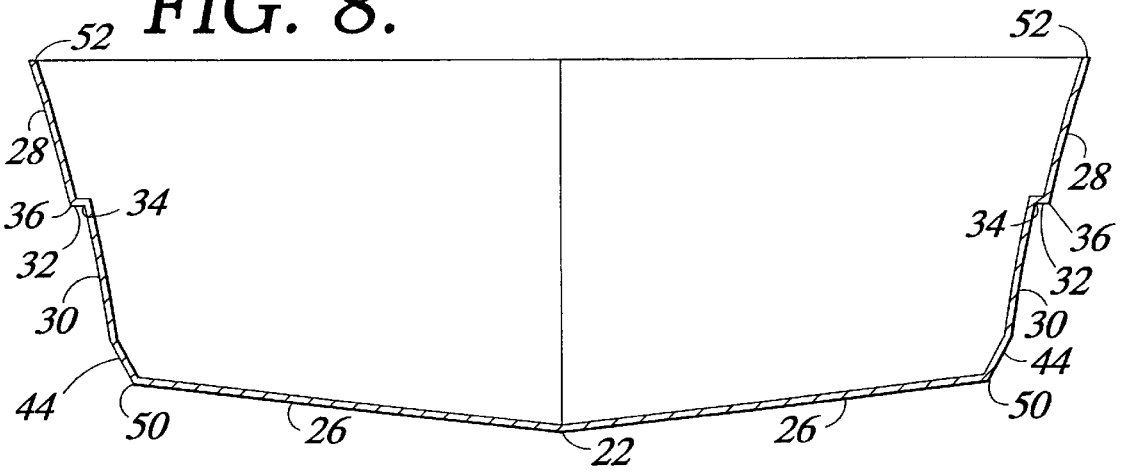
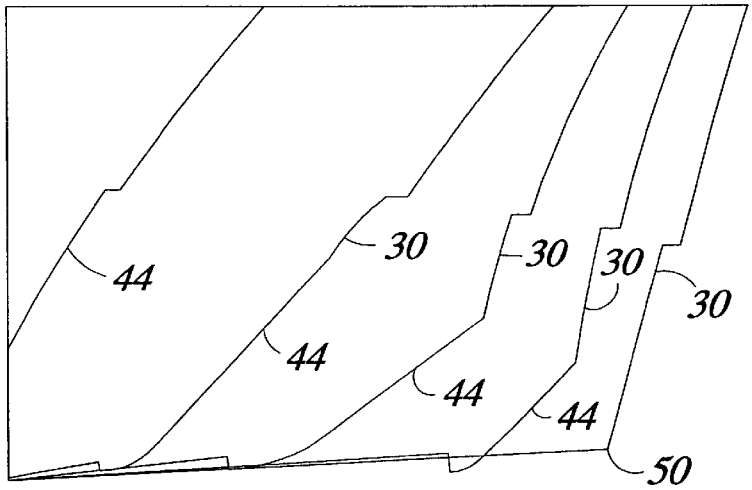
FIG. 9.
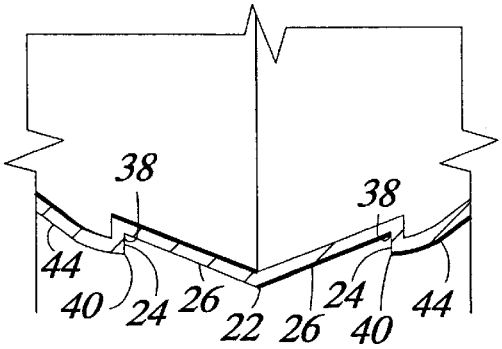
FIG. 10.
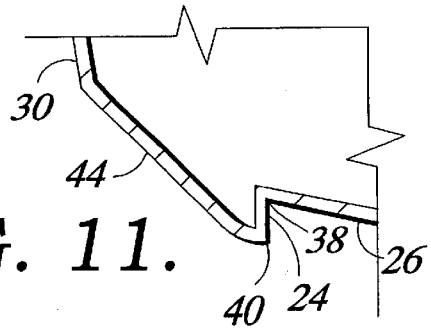
FIG. 11.

CHINE SYSTEM FOR A BOAT HULL

STATEMENT REGARDING FEDERALLY SPONSORED RESEARCH OR DEVELOPMENT

Not Applicable.

CROSS-REFERENCE TO RELATED APPLICATIONS

Not Applicable.

FIELD OF INVENTION

This invention relates to the field of boat hulls, and, more particularly, to a chine system that eliminates sound referred to as wave slap and diverts water spray created by a boat hull.

BACKGROUND OF INVENTION

Boat hulls with bottom configurations have been used in watercraft designs for many years. The V-hull is constructed by using a combination of conical shapes and planar surfaces. The intersection of the hull bottom with the side is called the chine. Typically, the chine intersection has taken three different shapes. First, a simple intersection between the bottom hull and the hull sides is called a hard chine. Second, a curved member blending the hull bottom with the hull sides is called a round chine. Finally, a horizontal intersection between the hull bottom and hull sides is simply referred to as the chine.

When the watercraft is moving across the water and as waves impact the hull at the waterline in displacement mode, the hard chine and the simple chine design create sound commonly referred to as wave slap. Displacement mode is a slow speed or static floating normally used during fishing. As the boat cuts through the water, impact created as the water slaps against bottom and sides of the boat hull creates the noise. A boat hull design that has been successful in reducing wave slap is the round chine.

Although round chines have been successful in controlling wave slap in displacement modes, such a design has failed to prevent water from climbing up the side of the boat hull when traveling at planing speed. This creates a water spray that could collect in the watercraft. Additional designs have been developed to prevent water from climbing up the side of the boat hull and reduce the spray effect. For example, a secondary chine member which includes a horizontal member attached to the side of the hull above the water line has been implemented to reduce the amount water climbing up the side of the hull and the amount of water spraying into the boat.

Accordingly, there remains a need in the boat hull industry for a chine system that will reduce the amount of sound that is created from the water slapping against the boat hull as it floats in displacement modes. In addition, there remains a need in the boat hull industry for a quiet chine system that will reduce the amount of water climbing up the side of the boat hull and reduce the amount of water spray when the boat is traveling at planing speed. The primary objective of this invention is to solve or substantially reduce the problems normally associated with known prior art chine systems.

SUMMARY OF INVENTION

Accordingly, it is the object of the present invention to provide a method and apparatus that reduces the amount of sound created between the water and the boat hull as the watercraft is used in displacement mode.

It is another object of the present invention to provide a method and apparatus that reduces the amount of water spray that enters the watercraft when traveling across the water at planing speed.

According to the present invention, the foregoing and other objects are achieved by a boat hull comprising a bottom panel(s) making up the bottom of the boat hull. A first chine member is a surface that has a base edge and an extended edge. The first chine member is coupled to the bottom panel at the base edge and protrudes generally in a vertical direction away from the boat hull. A curved surface member couples the extended edge of the first chine member to a set of side panels. The set of side panels extend from the curved member to the gunwale making up the, sides of the boat hull. A second set of chines are located on the set of side panels of the boat hull and extend in a horizontal direction away from the boat hull.

Additionally, the foregoing and other objects are achieved by a method for reducing wave slap and water spray. The method includes forming a bottom panel of a boat hull including a first chine member that extends downwardly from the bottom panel. A series of panels that extend from the first chine member to the gunwale forming the sides and includes a second chine member that extends horizontally from the side. In displacement modes, as the waves strike the bottom of the boat, the curved member reduces wave slap. The first and second chine members are located respectively below and above the waterline such that they do not interfere with the dampening effect. At planing speeds, as the hull trim increases, the locations of the first chine member is such that it intersects the waterline and deflects spray downward. The second chine member further deflects any spray that may get past the first chine member.

Additional objects of invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means and instrumentalities and combinations particularly pointed out in the appended claims.

BRIEF DESCRIPTION OF THE DRAWINGS

In the accompanying drawings which form a part of this specification and are to be read in conjunction therewith and in which like reference numerals are used to indicate like parts in the various views:

FIG. 8 is a cross-sectional view taken generally along line 8—8 of FIG.3 showing the boat hull with second chine member;

FIG. 9 is a compilation of views taken along lines 4—4, 5—5, 6—6, 7—7, and 8—8 of FIG. 3 showing the first chine member and second chine member;

FIG. 10 is an enlarged view of the chine system at location shown in FIG. 5;

FIG. 11 is an enlarged view of the chine system at a location shown in FIG. 7.

DETAILED DESCRIPTION OF THE PREFERRED EMBODIMENT

Figure 1:
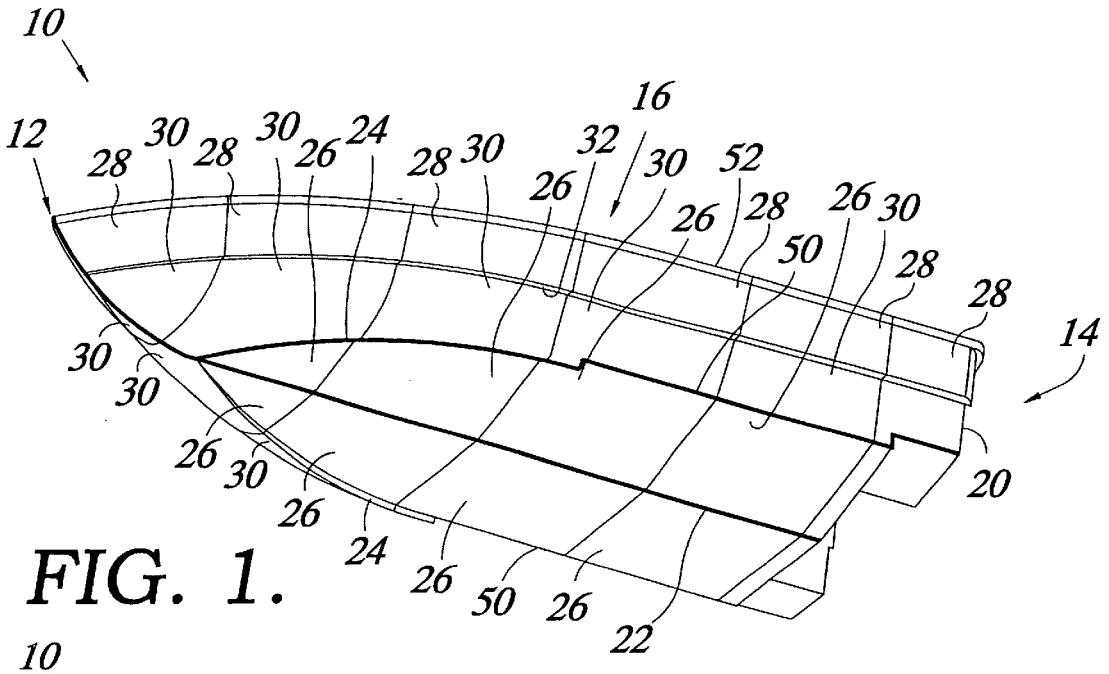
FIG. 1 is a perspective view of a bottom of a boat hull incorporating the present invention.
Figure 2:
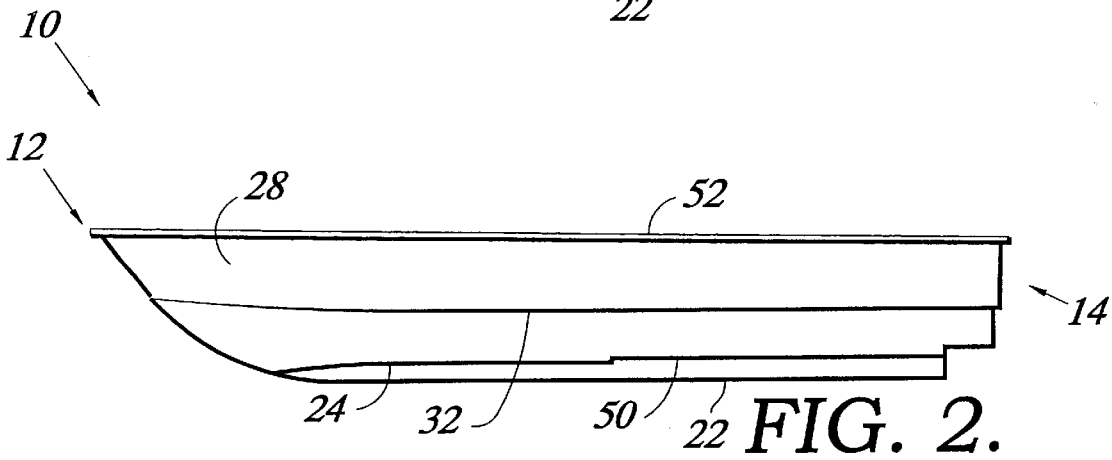
FIG. 2 is an elevational view of the port side of the boat hull incorporating the present invention.
Figure 3:
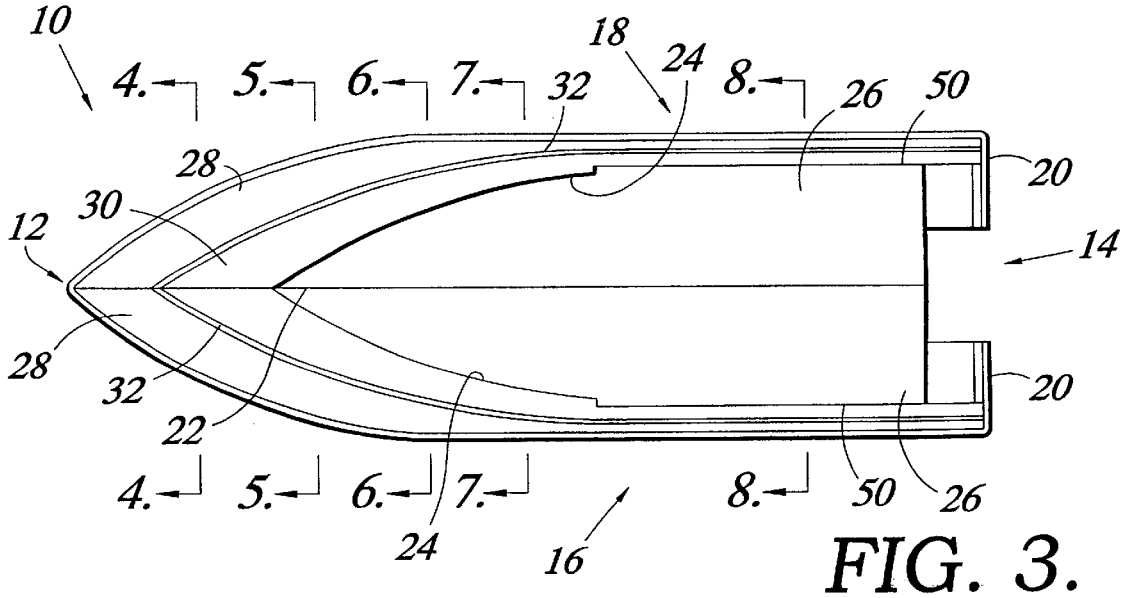
FIG. 3 is a bottom plan view of the boat hull incorporating the present invention.
Figure 4:
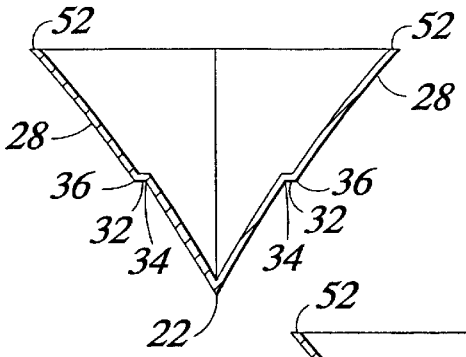
FIG. 4 is a cross-sectional view taken generally along line 4—4 of FIG. 3 showing the boat hull and second chine member.
Figure 12:
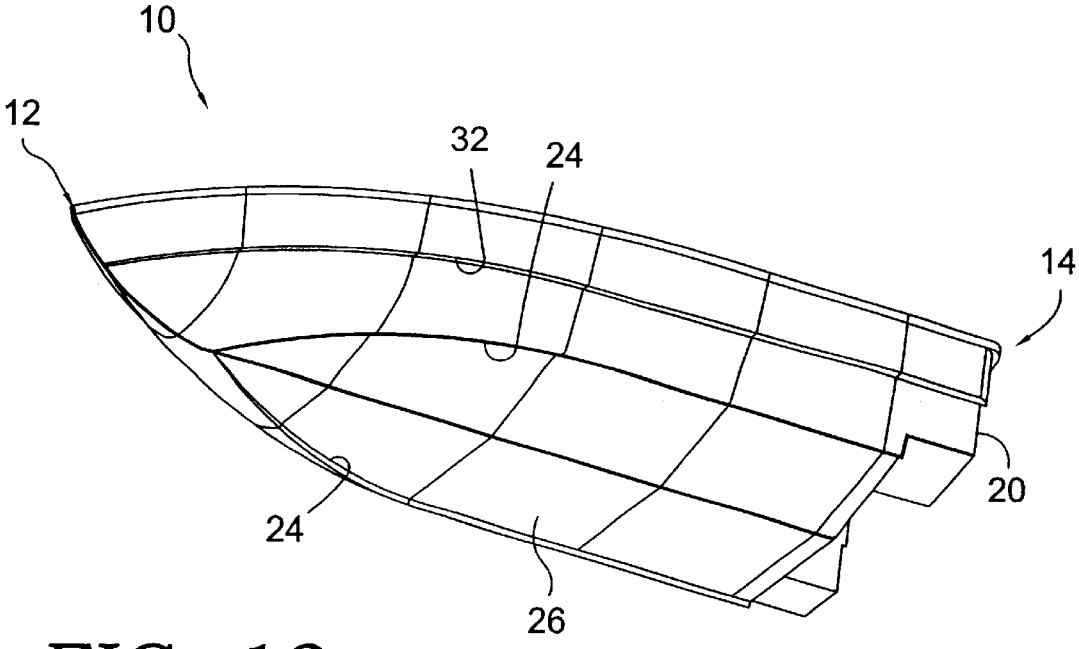
FIG. 12 is a view similar to FIG. 1 showing the first chine member extending to the stern of the boat hull.

Referring to the drawings in greater detail, and initially to FIGS. 1–3, a boat hull designated generally by the numeral 10 is shown and may be manufactured from any suitable material including but not limited to glass fiber, metal (including stretched aluminum), wood, glass or plastic. Boat hull 10 has a bow 12, stern 14, port side 16, starboard side 18, and a transom 20. A keel 22 extends along the longitudinal axis of boat hull 10 from bow 12 to stern 14 and abuts transom 20. As seen in FIG. 3, first chine member 24 diverges rearwardly below the static waterline to form a V-shape in plan view, and are positioned on opposite sides of keel 22. First chine member 24 begins at a point on the front of keel 22 toward bow 12, and moves away from keel 22 and toward transom 20. Preferably, first chine member 24 ends at a point approximately midway between bow 12 and stern 14, but it is understood that first chine member 24 could extend to transom 20, as best seen in FIG. 12, or be located there between.

Figure 5:
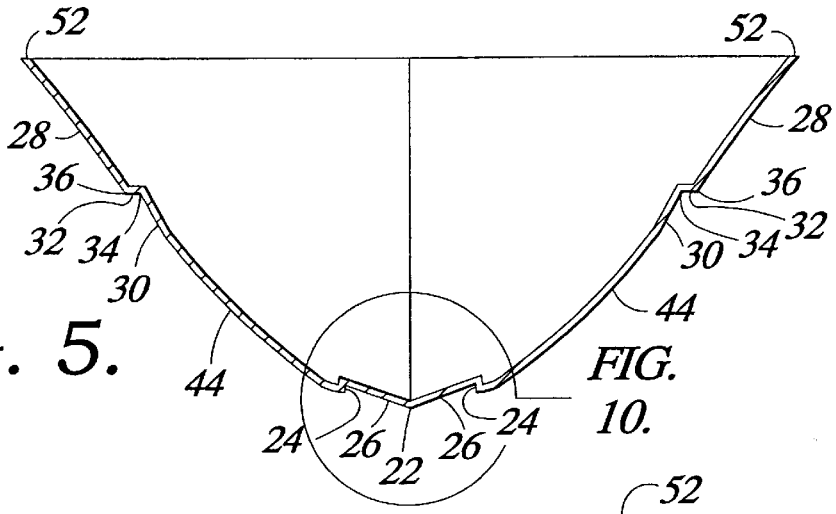
FIG. 5 is a cross-sectional view taken generally along line 5—5 of FIG. 3 showing the boat hull and second chine member.
Figure 6:
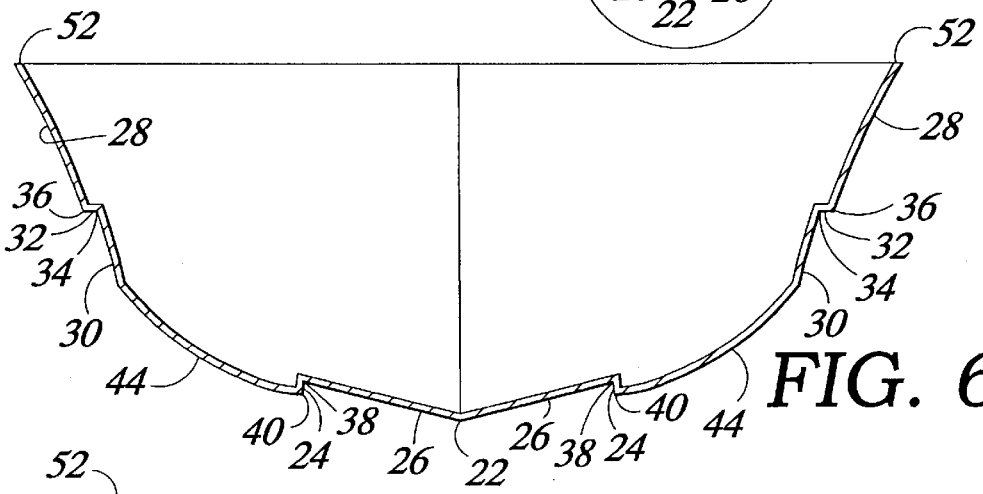
FIG. 6 is a cross-sectional view taken generally along line 6—6 of FIG. 3 showing the boat hull along with the first chine member and the second chine member.
Figure 7:
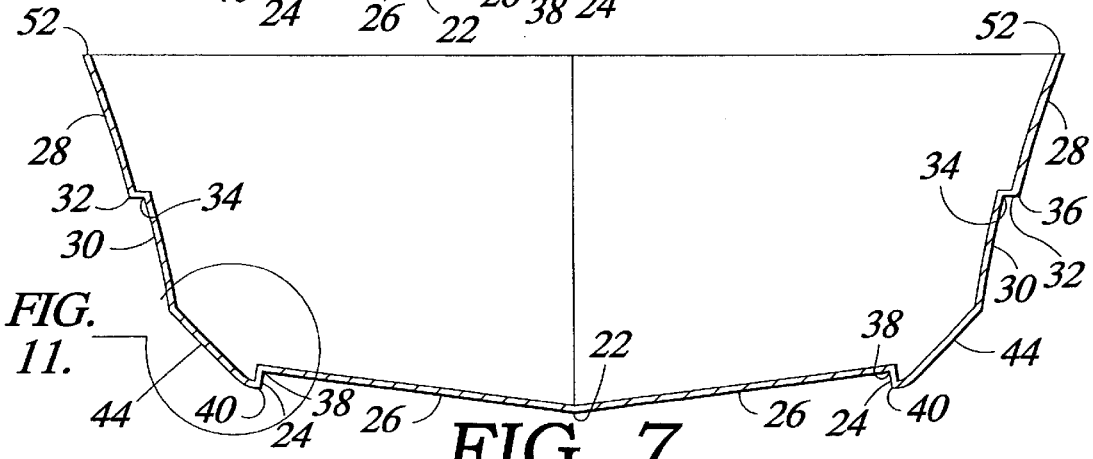
FIG. 7 is a cross-sectional view taken generally along line 7—7 of FIG. 3 showing the boat hull with the first chine member and second chine member.

Boat hull 10 further includes a set of bottom panels 26. As seen in FIGS. 5–7, bottom panels 26 form keel 22 and extend therefrom to first chine member 24 at an angle relative to a horizontal axis. Specifically, the bottom panels 26 extend from keel 22 at approximately the same angle moving toward the stern 14 of the boat hull 10. As seen in FIG. 2, keel 22 is positioned below the first chine member 24 as it extends toward the aft portion of hull 10. It should be understood that bottom panels 26 could extend from keel 22 to first chine 24 at varying angles or slopes. Depending on the selected angles of the bottom panels 26 relative to the horizontal, keel 22 can be made to extend even further below first chine member 24 than what is shown in FIG. 2 thereby altering the design of the boat bottom. The connection between set of bottom panels 26 and first chine member 24 will be described more fully below. As seen in FIG. 1, there may be multiple bottom panels 26 that connect keel 22 to first chine member 24, but it is within the scope of the present invention to use a solid bottom panel to make up the entire bottom of the boat hull 10 as shown in FIG. 3.

Boat hull 10 may further include a set of upper side panels 28 and lower side panels 30. As best seen in FIGS. 2 and 5–7, lower side panels 30 extend from second chine member 32 to curved member 44 that will be described more fully below. Upper side panels 28 above top of lower side panels 30 and extend from second chine member 32 to the gunwale 52 of boat hull 10 The connection of second chine member 32 to upper side panels 28 and lower side panels 30 will be more fully described below. As shown in FIG. 1, there may be multiple upper side panels 28 and lower side panels 30 that make up the sides of boat hull 10. As best shown in FIG. 2, it is within the scope of the present invention to use a single solid side panel and single lower side panel adapted to make up both sides of boat hull 10.

Second chine member 32 connects approximately horizontally to the set of upper side panels 28 and lower side panels 30. As best shown in FIG. 3, second chine member 32 is located along port side 16 and starboard side 18 and forms an apex forward V-shape in plan view. Preferably, second chine member 32 extends along the full length of the port side 16 and starboard side 18 and to transom 20, but it is understood that second chine member 32 could terminate intermediate thereof without departing from the inventive concept. Referring to FIGS. 5–7, set of lower side panels 30 extend upward and at an angle from curved panel member 44. First end 34 of second chine member 32 connects to the top edge of lower side panels 30 and then extends outwardly in substantially a horizontal direction and finally connect to the lower edge of upper side panels 28. Upper side panels 28 then terminate upwardly at gunwale 52 of boat hull 10. Stated another way, second chine member 32 forms a narrow approximately horizontal offset or lip between upper side panels 28 and lower side panels 30 on the port side 16 and starboard side 18 of boat hull 10.

First chine member 24 connects set of bottom panels 26 to the lower edge portion of curved panel member 44. The V-shaped first chine member 24, as seen in FIG. 3, extends away from keel 22 and toward transom 20 to a point midway between bow 12 and stern 14. It should be understood that first chine member 24 does not have to be continuous along its entire length or necessarily terminate approximately midway between bow 12 and stern 14. In other words, first chine member 24 could be "tooth-like" as it extends to a point midway between bow 12 and stern 14. Accordingly, there could be multiple sets of first chine members comprised within the V-shape boundary and positioned in between the aforementioned first chine member 24 and keel 22.

First chine member 24 has a base edge 38 and an extended edge 40. As best seen in FIGS. 6 and 7, bottom panels 26 are coupled with base edge 38 of first chine member 24. First chine member 24 then extends away from bottom panels 26 generally in a vertical direction to the extended edge 40. As seen in FIGS. 10 and 11, extended edge 40 of first chine member 24 is then coupled to curved member 44 that is preferably convex when viewed from the outside of boat hull 10. It should be understood that curved member 44 could be concave when viewed from the outside of boat hull 10. Curved panel member 44 is then coupled to bottom of lower side panel 30. As seen in FIG. 9, as the length of curved panel member 44 decreases from bow 12 to stern 14, the length of lower side panel 30 increases. It is within the scope of this invention to exclude curved panel member 44 and simply have a lower side panel 30 that intersects with extended edge 40 of first chine member 24.

First chine member 24 is flared outwardly in plan view as it extends from bow 12 to stern 14. First chine member 24 is flush with boat hull 10 at the point at which first chine member 24 intersects keel 22 toward bow 12 and tapers away from boat hull 10 as first chine member 24 extends toward stern 14. In other words, the length of first chine member 24 between base edge 38 and extended edge 40 increases as first chine member 24 extends from bow 12 to stern 14.

Preferably, the angle formed between first chine member 24 and the horizontal is approximately eighty-five degrees and first chine member 24 extends from bow 12 to stern 14. It has been found that this angle can functionally range from the stated eighty-five degrees. In addition, as illustrated in FIGS. 5–7, the angle between bottom panels 26 increase as they extend from bow 12 to stern 14. As a result, the angle formed between bottom panels 26 and first chine member 24 increases as they extend from bow 12 to stern 14.

After first chine member 24 ends at a point in between bow 12 and stern 14, bottom panels 26 and lower side panels 30 intersect to form a hard chine 50 that extends to transom 20. As seen in FIGS. 3 and 8, hard chine 50 is a simple intersection between bottom panels 26 and lower side panels 30.

In operation, boat hull 10 is capable of moving across a body of water at displacement or planing speeds. Displacement speeds are either substantially at rest in the water or slightly moving at idle or being polled. Planing speeds are higher speeds relative to displacement speeds. The first chine member 24 remains below the waterline when boat hull is a displacement mode. This allows boat hull 10 to move through the water with little disturbance thereby reducing the amount of sound created by the abrupt transition from bottom panels 26 and lower side panels 30 (when fishing). Thus, with first chine member 24 remaining below the static waterline in displacement mode, hard angles are eliminated that normally would cause wave slap. Accordingly, the first chine member 24 cooperates with the boat hull bottom shape to reduce the noise created by wave slap and enhance the boats's use as a fishing vessel.

Once the boat reaches planing speed, the trim of boat hull 10 changes such that the first chine member 24 is positioned at or above the surface of the water. As the V-shaped boat hull 10 displaces water outwardly, water begins to spray toward the sides 30, 44 of boat hull 10. Before the water spray reaches the sides 30, 44, the water spray is knocked down by the first chine member 24, thereby significantly reducing the amount of spray that could enter into the boat. If all the water is not knocked down by the first chine member 24, then second chine member 32 further reduces the amount of water that could potentially enter into the boat.

From the foregoing, it will be seen that this invention is one well-adapted to attain the ends and objects herein above set forth together with other advantages which are obvious and which are inherent to the structure. It will be understood that certain features and subcombinations are of utility and may be employed without reference to other features and subcombinations. This is contemplated by and is within the scope of the claims. Since many possible embodiments may be made of invention without departing from the scope thereof, it is to be understood that all matter herein set forth or shown in the accompanying drawings is to be interpreted as illustrative and not in a limiting sense.

I claim:

1. A boat hull having a bow and stern capable of moving through a body of water, the boat hull being comprised of:

a bottom panel having first and second ends, said first end forming at least a portion of a keel;

a first chine means coupled to said bottom panel and extending outwardly from said bottom panel at approximately a perpendicular angle relative to said bottom panel to form an outer edge, said first chine means extending from a location near the bow of the boat hull to a point intermediate of the bow and stern of the boat hull;

a side panel coupled to said first chine means; and a second chine means extending outwardly from said side panel, wherein said keel extends below said outer edge of said first chine means along a substantial portion of the longitudinal axis of the boat hull so that wave slap is reduced when the boat hull is used in displacement modes.

2. The boat hull as recited in claim 1, wherein said first chine means includes a V-shaped member.

3. The boat hull as recited in claim 2, wherein the apex of the V-shape is positioned toward the bow of the boat hull.

4. The boat hull as recited in claim 2, wherein said first chine member is flared, wherein the first chine member is flush with the boat hull at the apex of the V-shape and flares outwardly from said bottom panel as said first chine member extends toward the stern of the boat hull.

5. The boat hull as recited in claim 1, wherein said first chine means flares outwardly from said bottom panel as the said first chine member extends toward the stern of the boat hull.

6. The boat hull as recited in claim 1, wherein said first chine means extends outwardly at varying distances from said bottom panel.

7. The boat hull as recited in claim 1, wherein said first chine means extends outwardly from said bottom panel at approximately a ninety degree angle relative to a horizontal plane.

8. The boat hull as recited in claim 1, further comprising a curved panel member coupled to said first chine means and said side panel member.

9. The boat hull as recited in claim 1, wherein said second chine means extends outwardly from said side panels and at approximately a horizontal angle.

10. A chine system for a boat hull to reduce wave slap when the boat hull is used in displacement modes, said boat hull having a bow and stern, said chine system comprising:

a bottom panel having first and second ends, said first end forming at least a portion of a keel;

a plurality of first chine members having first and second edges, said first edge on at least one of said plurality of chines is coupled to said bottom panel and extending downwardly from said bottom panel to said second edge, said first chine members extending from a location near the bow of the boat hull to a point intermediate of the bow and stern of the boat hull a side panel coupled to one of said first chine members; and a second chine member coupled to said side panel, wherein said keel extends below said second edge of said first chine member along a substantial portion of the longitudinal axis of the boat hull.

11. The chine system as recited in claim 10, wherein second chine member extends outwardly from said side panel at approximately a horizontal angle.

12. The chine system as recited in claim 10, wherein at least one of said plurality of first chine members are V-shaped, wherein the apex of the V-shape is positioned towards the bow of the boat hull.

13. The chine system as recited in claim 12, wherein at least one of said plurality of first chine members is tapered, wherein at least one of said plurality of first chine members are flush with the bottom section at the apex of the V-shape and tapers away from the said bottom section as the said first chine member extends rearwardly toward the stern of the boat hull.

14. The chine system as recited in claim 10, wherein at least one of said plurality of first chine members is tapered, wherein at least one of said plurality of first chine members are flush with the bottom section at a location near the bow of the boat hull and protrudes away from said bottom section as the said first chine member extends rearwardly toward the stern of the boat hull.

15. A method for forming a boat hull that will reduce wave slap when floating in or traveling through a body of water, the boat hull having a bow and a stern, said method comprising the steps of:

forming a bottom panel having first and second ends;

providing at least a portion of a keel with said first end of said bottom panel;

providing a first chine member that extends substantially downwardly from said bottom panel to an outer edge, providing a side panel;

coupling said side panel with said first chine member;

providing a second chine member extending from said side panel;

extending said keel below said outer edge of said first chine member along a substantial portion of the longitudinal axis of the boat hull so that the boat hull deflects the water in such a way to reduce the amount of sound created between the water and boat hull when the boat hull is floating in or traveling through the water.

16. The method as recited in claim 15, wherein said first chine member is V-shaped.

17. The method as recited in claim 15, wherein said first chine members are flared, wherein said first chine member is flush with the boat hull and protrudes outwardly from said bottom panel as the said first chine member extends toward the stern of the boat hull.

18. A boat hull having a bow and stern, said boat hull comprising:

a bottom section having first and second ends, said first end forming at least a portion of a keel;

means for reducing the sound made between the boat hull and the water, using a first chine member coupled with said bottom section and extending outwardly from said bottom section, said first chine member extending from a location near the bow to a point intermediate of the bow and stern;

a side section coupled with said first chine member; and means for reducing the amount of water spray that enters the boat hull using a second chine member extending outwardly from said side section along a substantial portion of the longitudinal axis of the boat hull.

* * * * *